United States Patent [19]

Corsette

[11] Patent Number: 4,738,398

[45] Date of Patent: Apr. 19, 1988

[54] SPRAYER HAVING INDUCED AIR ASSIST

[76] Inventor: Douglas F. Corsette, 6559 Firebrand St., Los Angeles, Calif. 90045

[21] Appl. No.: 890,277

[22] Filed: Jul. 29, 1986

[51] Int. Cl.[4] ..... B05B 7/04

[52] U.S. Cl. ..... 239/427.3; 239/428.5; 239/432; 239/590.3; 261/78.2; 261/116; 261/DIG. 65

[58] Field of Search ..... 239/427, 427.3, 428.5, 239/432, 590.3, 343, 370, 311; 222/564; 261/78.2, 116, DIG. 65

[56] References Cited

U.S. PATENT DOCUMENTS

| | | | |
|---|---|---|---|
| 3,724,762 | 4/1973 | Freshour et al. | 239/428.5 X |
| 4,135,670 | 1/1979 | Sugimoto | 239/428.5 |
| 4,219,159 | 8/1980 | Werner | 239/428.5 |
| 4,223,842 | 9/1980 | Hayes | 261/78.2 X |
| 4,350,298 | 9/1982 | Tada | 239/428.5 X |
| 4,646,973 | 3/1987 | Focaracci | 239/428.5 |

FOREIGN PATENT DOCUMENTS

| | | | |
|---|---|---|---|
| 646543 | 6/1937 | Fed. Rep. of Germany | 239/427.3 |
| 1420750 | 3/1965 | France . | |

*Primary Examiner*—Andres Kashnikow
*Assistant Examiner*—Mary Beth O. Jones
*Attorney, Agent, or Firm*—Watson, Cole, Grindle & Watson

[57] ABSTRACT

Spray discharge from a liquid sprayer is enhanced through a turbulent effect created by a ported baffle defining an air plenum into which air is induced to flow into the spray plume as it emerges from the discharge orifice causing the particles to collide and mix with the emerging spray. The baffle port is sized to match the divergence angle of the spray plume which essentially fills the port upon entry such that the air in the gap between the orifice and the port is driven through the port by impingement of the spray particles and entrainment of the air into the plume from the gap, while preventing any backflow of air through the port.

6 Claims, 2 Drawing Sheets

SPRAYER HAVING INDUCED AIR ASSIST

BACKGROUND OF THE INVENTION

This invention relates generally to a fluid delivery system for consumer products, and more particularly to a sprayer having an induced air assist downstream of the discharge orifice resulting in a fine and more consistent spray particle breakup.

There are basically three main types of fluid sprayers for consumer products, such as window cleaners, liquid detergents, perfumes, colognes, anti-perspirant, bug sprays, etc. The manually operated pump sprayers, the deformable or squeeze bottles and the aerosols are considered the main sprayer categories. Aerosols include those having a mechanical breakup system to effect a spray, a vapor tap valve system and/or the mutually soluble product/propellant system. The system employed for the spray mechanics upstream of the discharge orifice for the pump, squeeze and aerosol sprayers may differ geometically as required by the nature of the product, the nature of the discharge desired (narrow/wide, fine/coarse, dry/wet, etc), and the discharge rate/amount.

The squeeze bottle sprayers may include spin mechanics upstream of the discharge orifice, and/or may include an air passage into the area behind the discharge orifice from within the container to inject air under pressure into the fluid to be discharged, to effect particle breakup, or for creating a foam assuming the liquid product includes a foaming agent. Or, an homogenizng element in the discharge path creates a foam as the foamable product passes through such element upon application of each external force applied to the squeeze bottle.

Some aerosols have a foaming system of the externally generated type provided by vapor tap valves, and/or several turbulence generators, screens, chambers, etc. These latter types are intended to function at least partially externally to the principal discharge orifice, but normally take maximum advantage of the aerosol component capabilities and include a foaming agent and a foam-expnsion means, etc.

U.S. Pat. No. 4,350,298 discloses a pump sprayer having an external foam generator in the form of a plurality of arms constituting an obstacle wall or spattering device with which the spray liquid from the orifice collides when the foam dispenser is at its foaming position.

U.S. Pat. No. 4,219,159 discloses a pump sprayer requiring an aspirating chamber, a foam forming chamber, an expansion chamber and a pair of spaced mesh screens to facilitate foaming.

French Patent No. 1,420,750 discloses an aerosol sprayer having a discharge head with a skirt wall spaced from the spray button, the skirt having a window through which the nozzle projects the discharge.

SUMMARY OF THE INVENTION

It is therefore an object of the present invention to provide a fluid sprayer as having an induced air assist for enhancing the spray discharge emitted from the discharge orifice but without the need for prior art elements such as a diffuser target plate, a diffuser screen, nebulizing chambers, etc.

In carrying out this objective, the spray discharge emitted from a spray discharge orifice is enhanced by employing a ported baffle positioned an appropriate distance downstream from the discharge orifice, and having an appropriately sized open port coaxially aligned with the axis of the discharge spray plume, the size of the port being greater than that of the discharge orifice and being sized to accommodate the spray plume at the location of the baffle. Thus, the spray plume is caused to "jump the gap" between the discharge orifice and the baffle port. By sizing the port to suit the size and/or divergence angle of the discharge plume thereat, air in the gap is driven through the port by impingement of the spray particles and entrainment of the air into the plume from the gap. Normal recirculation around a free spray plume is prevented upstream of the baffle because the baffle port is sized so that the discharge plume and entrained air essentialy fill the port, preventing any backflow therethrough.

Downstream of the baffle, the air modulated spray plume behaves in a manner dependent on the size and configuration of the port in the baffle which can be configured as a secondary nozzle. The simplest form permits a relatively normal interaction of the modulated spray plume emerging from the baffle port to generate a circulation of ambient air forward of the baffle wherein the fringes of the plume which are decelerated by impingement on relatively static or air moving back toward the baffle. This circulation is caused by the driving force of the plume impacting air forward of the spray plume, entraining surrounding air and carrying it with the plume, leaving a reduced pressure at the front of the baffle adjacent the port. Thus, some additonal air is drawn laterally toward the plume ahead of the baffle as well as from the recirculation component external to the discharge orifice of the plume. These lateral air movements radially transverse to the direction of spray cause turbulence in the plume by air impingement, resulting in increased collisions between spray particles, and thus assisting to break up the spray into finer particles.

Other objects, advantages, and novel features of the invention will become more apparent from the following detailed description of the invention when taken in conjunction with the accompanying drawings.

DETAILED DESCRIPTION OF THE INVENTION

Figure 1:
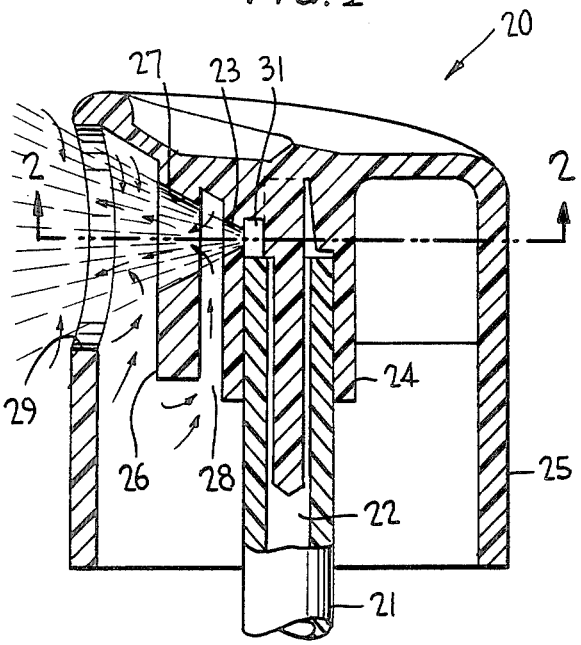
FIG. 1 is a vertical sectional of part of the pump sprayer embodying the invention.

Turning now to the drawings wherein like reference characters refer to like and corresponding parts throughout the several views, a liquid sprayer is generally designated 20 in FIG. 1 and may be in the form of a manual pump sprayer or aerosol having a sprayer body which includes a discharge tube 21 containing a discharge passage 22 which terminates in a discharge orifice 23 which, in the example illustrated, is located in a skirt 24 of a discharge head 25 of the sprayer body. otherwise, the discharge orifice could be located in the discharge tube, or in another portion of the discharge head, without departing from the scope of the invention.

Figure 2:
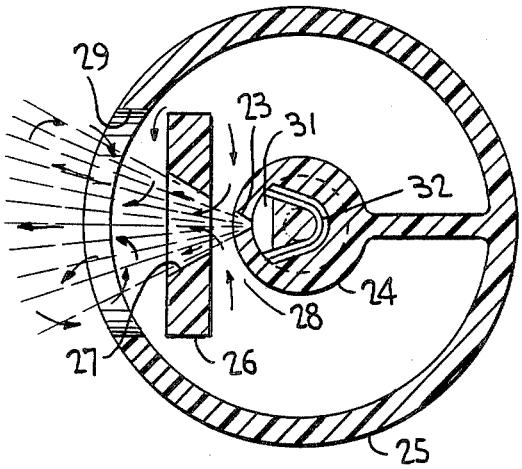
FIG. 2 is a cross-sectional view taken substantially along the line 2—2 of FIG. 1.

A baffle plate 26 is affixed to the discharge head external to the discharge orifice, and has an appropriately sized open port 27 coaxial with the discharge orifice, of a size greater than that of orifice 23 and approximate to the size and/or divergence angle of the spray plume at the location of the baffle plate, for a purpose to be described in more detail hereinafter. The baffle plate is spaced from skirt or wall 24 containing the discharge orifice so as to present a gap therewith and an unobstructed plenum 28 which includes the adjacent atmosphere. The opposing surfaces of the baffle plate are fully open to the atmosphere as shown in FIGS. 1 and 2. And, the discharge head has an oversized opening 29 through which the spray is discharged and may be configured to serve as ad additional element in the segmented exit cone, adding a cascade effect.

The pump housing and/or discharge head may have a swirl or spin chamber, such as 31 with spin mechanics such as spin grooves 32 associated therewith, to internally effect a vortex of the liquid product causing the product to discharge from orifice 23 as a spray plume typically in the form of a diverging spray cone. Any other spin mechanics may be employed for producing a vortex of the liquid product, as for example disclosed in my U.S. patent application Ser. No. 694,101, filed Jan. 23, 1985.

The spray plume is thus caused to jump the gap between the discharge orifice and port 27 in baffle plate 26. By sizing the port to suit the size and/or divergence angle of the discharge plume at the location of the baffle plate, air in the gap is driven through port 27 by impingement of the spray particles and entrainment of the air into the plume from the gap. Normal recirculation as around a free spray plume is prevented behind the baffle plate (i.e. upstream thereof) because baffle port 27 is sized so that the discharge plume essentially fills the port, thereby preventing any backflow of air through the port.

Thus, the provision of an external baffle plate 26 with an appropriately sized port 27 coaxial with the discharge orifice so as to be centered on the principal axis of the discharge plume, causes a controlled induced air flow into that portion of the discharge plume immediately as it emerges from the discharge orifice to thereby add turbulence transverse to the discharge axis. This will increase the collisions between the spray particles in the discharge and add air mass and mixing, resulting in a finer, more consistent liquid particle breakup. If the product discharge is a foamable product or has a foaming ingredient, the ported baffle will cause the discharge to be converted to a foam as it emerges from the baffle port. Should the discharge be convertible from a divergent cone to a stream, or to a narrower spray which does not bear the correct relationship to the port in the baffle, then the enchancement factor is not in effect and the discharge plume or stream is essentially unaffected.

Figure 6:
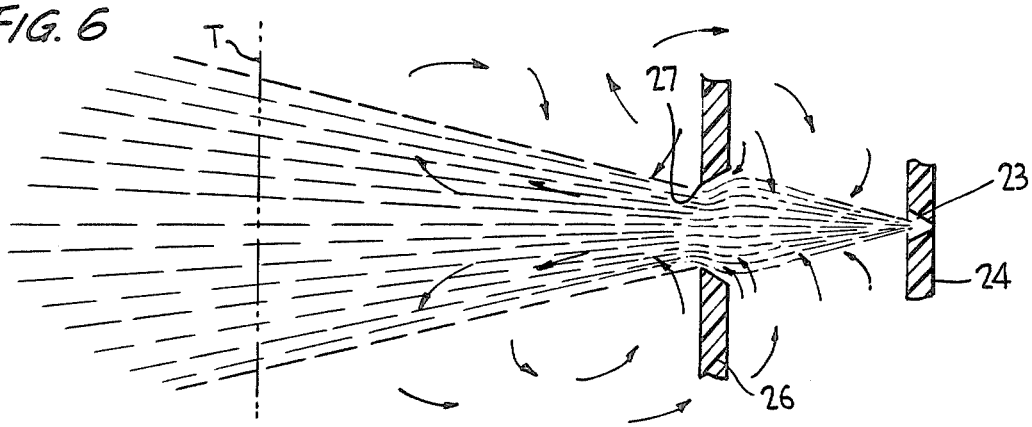
FIG. 6 is a schematic illustration, at an enlarged scale, of a spray plume and the air entrainment as the spray jumps the gap between the discharge orifice and the port in a confronting baffle according to the invention.

The gap is part of air plenum 28 into which induced air is caused to flow laterally to the axis of the discharge plume as represented by the air arrows shown in FIGS. 1 and 2. This air plenum must be free of any obstructions which would prevent an unobstructed flow of air, without interference, transversely to the plume axis for creating a turbulent effect which increases collisions between the spray particles immediately upon the spray issuing from the discharge orifice. In other words, the wall containing the discharge orifice must be spaced a predetermined distance from the baffle plate containing port 27. This turbulent effect adds air which mixes with the colliding spray particles and likewise prevents any backflow of air through the baffle port but permits a recirculation outboard of the baffle as air thereat is entrained with the discharge. That is, on the downstream side of the baffle port the spray plume behaves in the normal manner of circulation with the air circulation at the fringes of the plume being decelerated and redirected back toward the baffle plate, as graphically illustrated in FIG. 6 by the air arrows. This circulation is caused by the driving force of the plume entaining surrounding air and carrying it with the plume, leaving a reduced pressure at the downstream side of the baffle plate adjacent its port. Thus, some additional air is drawn laterally toward the plume downstream of the baffle plate as well as from the recirculation component external to the discharge orifice. These laateral air movements transverse to the direction of the spray causes turbulence in the plume by air impingement resulting in a finer and more consistent spray particle breakup, and tends to form an envelope about the spray plume.

As illustrated in FIGS. 1 and 2, the spray plume essentially fills baffle port 27 by which is meant that the spray plume to some extent adapts itself to the size of the baffle port by expanding slightly to essentially fill the port which may be sized slightly greater than the size of the spray plume at the location of the baffle plate, or which slightly constricts the spray plume as it enters the baffle port (Fig. 6) if the port is sized slightly less than the size of the spray plume at the location of the downstream end of the baffle plate port.

For the purpose of accommodating varying physical properties, spray, and/or foamability characteristics coupled with the different operating pressures generated by different users, the size of the baffle port and thickness of the baffle plate will be chosen for a typical application having some range of effectiveness. Thus, the parameters as to the size of the gap between the discharge orifice and the baffle port, the size of the baffle port, the thickness of the baffle plate, etc., will be configured depending on the nature of the fluid being discharged, the size and distance of the target area, the discharge pressure and volume, etc.

Figure 5:
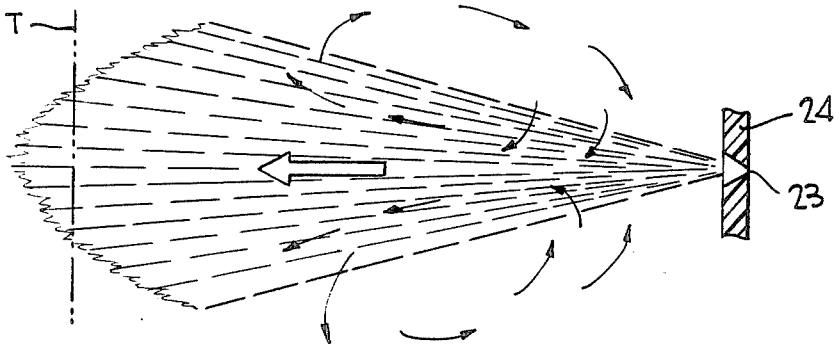
FIG. 5 (PRIOR ART)
FIG. 5 is a schematic illustration of a spray plume and air entrainment when emitted as a spray from a conventional spray nozzle.

FIG. 5 is a schematic illustration of a discharge plume issuing from a conventional nozzle having a discharge orifice 23 without the provision of a ported baffle plate as for the purpose and in the manner of the invention. As illustrated by the air arrows, the spray plume behaves in a typical manner of circulation with the circulated air at the fringes of the plume being decelerated and redirected back toward the discharge orifice where the pressure is reduced as the spray emerges from orifice 23. Comparing FIG. 5 with the ported baffle effect illustrated in FIG. 6, it can be seen that for a spray plume of a given size and/or divergence angle at the location of the baffle plate, the spray plume is somewhat of a reduced size upon issuing from the baffle port because of the turbulent effect created in the space between the baffle and the discharge orifice. It has been found that with the ported baffle approach of the invention, the spray against a given target T is finer and more evenly distributed compared to a wetter spray when reaching the same target T as illustrated in FIG. 5.

Figure 3:
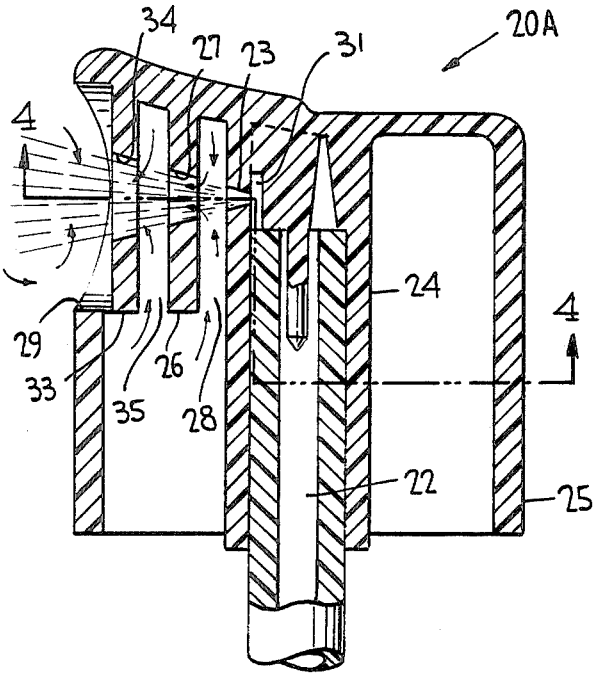
FIG. 3 is a view similar to FIG. 1 of another embodiment of the invention.
Figure 4:
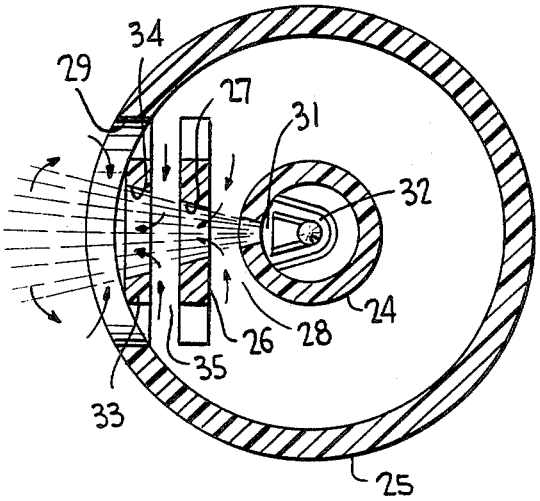
FIG. 4 is a cross-sectional view taken substantially along the line 4—4 of FIG. 3.

As shown in FIGS. 3 and 4, an additional baffle plate 33 may be affixed to discharge head 25 to achieve an added effect on the discharge plume. Baffle plate 33 is ositioned downstream of baffle plate 26 and has a port 34 coaxial with port 27 and discharge orifice 23, and forming a gap with baffle port 27. An unobstructed air plenum 35 including the adjacent atmosphere is defined between the baffle plates, and opposing sides of plate 33 are open to the atmosphere. The size of baffle port 34 is greater than that of baffle port 27, and may be approximately equal to the size and/or divergence angle of the spray plume at the location of plate 33. Other choices can be made depending on the desired effect to be achieved. The gap between the baffles serves to amplify the introduction of lateral air flow into the spray plume through port 34 with the plume, as shown by the air arrows in FIGS. 3 and 4. The natural circulation around the plume is now downstream of baffle plate 33. The second ported baffle plate provides for sequential mitigation of the discharage so as to produce a cascading effect on the discharge plume. And, a third ported baffle plate (not shown) could be affixed to the discharge head, downstream of the second baffle plate to define a third air plenum and a gap between ports, with the port of the third plate being sized to the spray plume depending on the intended effect, for producing a further mitigation of the spray plume in the manner aforedescribed.

As described with reference to the single baffle plate of FIGS. 1 and 2, the spray plume substantially fills port 34 as air in the gap or air plenum between the baffles is driven through port 34 by impingement of the spray particles issuing from port 27 which thereby entrains air laterally from air plenum 35 into the spray plume for creating a turbulent effect which increases collisions between the spray particles, prevents any backflow of air thorugh port 34 and adds air mass and mixing with the spray particles resulting in a still finer and more consistent spray particle breakup. Again, the parameters as to the size of the gap between the baffle plates, port diameters, baffle plate thicknesses, etc., may be configured depending on the nature of the fluid being emitted, the size and distance of the target area, the discharge pressure and volume, the effect desired, etc.

The provision of one, two or more ported baffle plates is appropriate whether the primary discharge is generated by a pressure agent such as compressed gas, or by manual pressure such as with a pump sprayer. And, these parameters will be chosen for a typical spray application having some expected range of effectiveness sufficiently broad to accommodate, for example, operating pressures generated by different users. Thus, the accommodation of varying end use products and user inconsistency is served.

The baffle port becomes a section of a segmented discharge nozzle as though a slice had been removed at the gap. Successive ported baffles add length and added elements to the segmented exit cone of the nozzle, and additonal air mixing and mitigation of the discharge plume.

In the sprayer 20A of FIG. 3, second baffle plate 33 can be integrally formed with the skirt of discharge head 25 for achieving essentially the same mitigations of the discharge.

Moreover, the baffle plates may be in the form of spaced, concentric cylindrical skirts, rather than flat plates, without departing from the invention.

In the FIGS. 1 and 3 embodiments, discharge orifice 23 is shaped as an outwardly diverging conical wall of a given slope, and baffle port 27 is shaped as an outwardly diverging conical wall of the same slope. Moreover, the diameter at the inner or upstream edge of port 27 is greater than the diameter at the outer or downstream edge of orifice 23. And, in sprayer 20A, baffle port 34 is shaped as an outwardly diverging conical wall of the same slope as that of port 27. The diameter at the inner or upstream edge of port 34 is greater compared to the diameter at the outer or downstream edge of port 27. Thus, the gap between the discharge orifice and port 27 of sprayers 20 and 20A, and the further gap between the baffle plates of FIGS. 3 and 4, function to amplify the indroduction of lateral air flow into the plume through the first baffle port and then through the second baffle port (FIGS. 3,4) with the plume. Because of the relative sizing of 23, 27 and 34, and the relative slope thereof, each time the spray plume jumps the gap or gaps the air in the gap or gaps is driven through the port or ports by impingement of the spray particles and entrainment of the air into the plume from the gap or gaps. Since the baffle ports are sized substantially to capture the plume at the location of the baffles, and have divergence angles which engage the plume, the spray plume will essentially fill the baffle port or ports to prevent any backflow of air therethrough which would otherwise impede the induction of air into the plume through the air plenum or plenums. Such impedence would therefore diminish the infusion of turbulence and reduce particle breakup.

The outwardly diverging orifice 23, and ports 27, 34 may all be of the same slope, but not necessarily congruent with the same cone. The baffle ports are thus essentially sized to suit the divergence angle of the discharge plume which fills each port upon entry and spreads out slightly as it emerges through and from each port. In general, the spray plume is coated with an air envelope as it enters each port when appropriately sized so that discharged product is not left on the walls of the ports, but is purged through the ports by the air envelope. If backflow were to occur, some wetting could result. And, because of the air entrainment from the air plenums the emerging plume may tend to constrict as it enters the next baffle port. This is because the air in each gap is at a higher static pressure.

Figure 7:
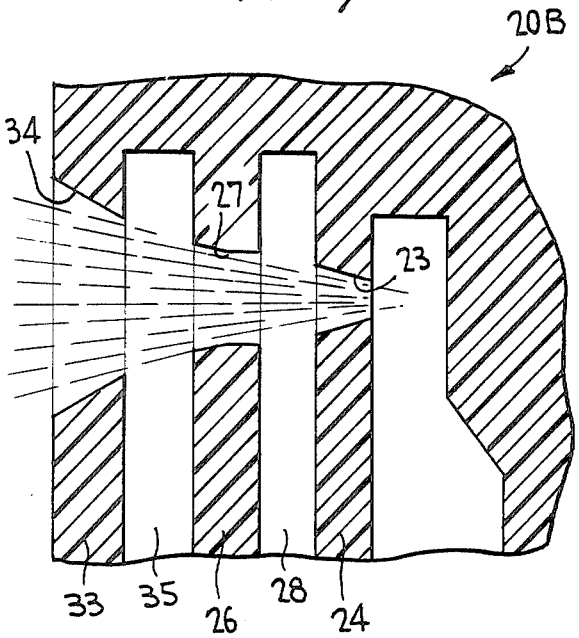
FIGS. 7 and 8 are views similar to FIG. 1 of parts of liquid sprayers of other embodiments according to the invention.

In sprayer 20B of FIG. 7, the outwardly diverging conical discharge orifice 23 and at least the downstream portion of port 27 are of the same slope. As shown, the upstream portion of port 27 may be cylindrical, the diameter of which is greater than the exit diameter of orifice 23. And, the outwardly diverging conical port 34 is sloped at a greater angle to the horizontal, with its inner diameter larger than the outer diameter of port 27. The spray plume is mitigated as it enters and emerges from the baffle ports similarly as aforedescribed.

Figure 8:
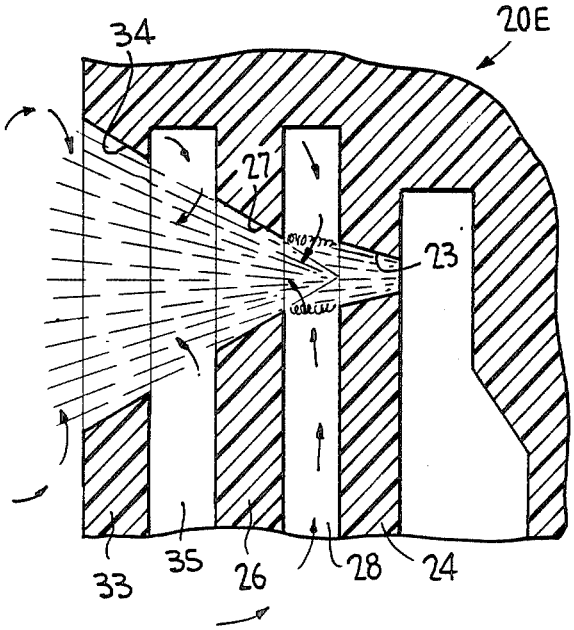

Alternatively, and without departing from the invention, the outwardly diverging conical baffle ports 27,34 may be of the same slope, although the outwardly diverging discharge orifice may be of a smaller slope to the horizontal, as shown in FIG. 8. The outer and inner diameters of 23 and 27, respectively, may be substantially the same, and the inner diameter of 34 may be greater than the outer diameter of 27. Thus, the spray plume emerges from the discharge orifice and tends to constrict as it is mixed with the induced air from air plenum 28 sufficiently to enter port 27 where it fills the port and tends to flare out to match its slope. Upon emerging from 27 the spray plume fills the port 34 opening as it enters and tends to follow its slope until it emerges toward the target.

Otherwise, discharge orifice 23 and baffle port 27 may be formed as straight cylinders with the latter being of a larger diameter. And, port 34 may be formed as an outwardly diverging cone having its inner diameter greater than the diameter of port 27. Upon emerging from the discharge orifice, the spray plume tends to spread out to substantially fill discharge port 27. And, after emerging again spreads out to substantially fill port 34, the plume being mitigated as it moves through the ports essentially as aforedescribed.

From the foregoing, it can be seen that the ported baffle approach taken according to the invention enhances the spray discharge and provides air assist to the spray plume. Each baffle provides an air plenum, and each baffle port forms a ring presenting an air gap which the spray plume jumps upon emergence from the discharge orifice and subsequently upon emergence from the first port, and from the second port if a second ported baffle is provided. The air induced into the air plenum or plenums flows into the spray plume immediately as it emerges from the discharge orifice and as it emerges from the first baffle port to thereby add turbulence transverse to the discharge axis. This increases the collisions between the spray particles in the discharge and adds air mass and mixing, thereby resulting in a finer, more consistent particle breakup. By sizing the port or ports to suit the divergence angle of the spray plume, air in the gap is driven through the port or ports by impingement of the spray particles and entrainment of the air into the plume from the gap without any backflow of air through the baffle port or ports. Thus, the turbulent effect is assured, and the spray plume behaves in the typical manner of circulation as it emerges from the last baffle with the air circulation at the fringes of the plume being decelerated and redirected back toward the last baffle.

Particle breakup is effected solely by the turbulence created, and not by impingement of the spray particles against the baffles or the port walls.

Obviously, many other modifications and variations of the invention are made possible in the light of the above teachings. It is therefore to be understood within the scope of the appended claims the invention may be practiced otherwise than as specifically described.

What is claimed is:

1. A liquid sprayer having a sprayer body containing a single discharge orifice located in an outer wall through which liquid is capable of being discharged in the form of a non-jet divergent liquid spray plume of a given size in a forward direction, comprising, a first baffle plate mounted on said body at a spaced predetermined distance from said orifice in said forward direction, opposing surfaces of said plate being open to the atmosphere, said plate having a single open port therein lying along the axis of said orifice, said plate presenting a gap with said wall so as to define an unobstructed first air plenum including the adjacent atmosphere, and the size of said port being greater than that of said orifice and being sized to accommodate the spray plume at the location of said baffle plate so that the spray plume continues through said port as a non-jet and substantially fills said port as air in said gap is driven through said port by impingement of the spray particles issuing from said orifice which thereby entrains air laterally from said plenum into the spray plume for creating a turbulent effect which increases collisions between the spray particles, prevents any backflow of air through said port and adds air mass and mixing with said spray particles resulting in a finer and more consistent spray particle breakup.

2. The sprayer according to claim 1, wherein a second baffle plate is mounted on said body at a spaced predetermined distance from said port in said forward direction, opposing surfaces of said second plate being open to the atmosphere, said second plate having an open port therein lying along said axis, said second plate presenting a second gap with said first plate so as to define an unobstructed second air plenum including the adjacent atmosphere, and the size of said second plate port being greater than that of said first plate port and being sized to accomodate the spray plume at the location of said second plate so that the spray plume substantially fills said second plate port as air in said second gap is driven therethrough by impingement of the spray particles issuing from said first plate port which thereby entrains air laterally from said second plenum into the spray plume for enhancing said turbulent effect which increases collisions between the spray particles, prevents any backflow of air through said second plate port and adds air mixing with said spray particles resulting in a still finer and more consistent spray particle breakup.

3. The sprayer according to claim 1, wherein said discharge orifice is formed as an outwardly diverging conical wall of a given slope, said port being formed as an outwardly diverging conical wall of a slope equal to said given slope.

4. The sprayer according to claim 2, wherein said discharge orifice is formed as an outwardly diverging conical wall of a given slope, said first plate port and said second plate port each being formed as an outwardly diverging conical wall of a slope the same as said given slope.

5. The sprayer according to claim 4, wherein the diameter at an inflow side of said first plate port is greater than the diameter at an outflow side of said orifice, and the diameter at an inflow side of said second plate port is greater than the diameter at an outflow side of said first plate port.

6. The sprayer according to claim 2, wherein said discharge orifice is formed as an outwardly diverging conical wall of a given slope, said first plate port being formed as an outwardly diverging wall of a slope the same as said given slope, and said second plate port being formed as an outwardly diverging wall of a slope greater than said given slope.

* * * * *